US005413811A

United States Patent [19]

Fitting et al.

[11] Patent Number: 5,413,811

[45] Date of Patent: May 9, 1995

[54] CHEMICAL AND MECHANICAL SOFTENING PROCESS FOR NONWOVEN WEB

[75] Inventors: Steven W. Fitting, Acworth; John J. Sayovitz, Marietta; Joel E. Edwards, La Grange; Gregory T. Sudduth, Lawrenceville, all of Ga.

[73] Assignee: Kimberly-Clark Corporation, Neenah, Wis.

[21] Appl. No.: 210,203

[22] Filed: Mar. 18, 1994

[51] Int. Cl.[6] ..... B05D 3/12

[52] U.S. Cl. ..... 427/176; 8/132; 156/164; 156/229; 427/171; 428/903

[58] Field of Search ..... 156/229, 164; 427/171, 427/176; 8/132; 428/903, 198

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 3,855,046 | 12/1974 | Hansen et al. | 161/150 |
| 3,909,009 | 9/1975 | Cvetko et al. | 274/37 |
| 3,973,068 | 8/1976 | Weber | 428/198 |
| 4,013,816 | 3/1977 | Sabee et al. | 428/288 |
| 4,041,203 | 8/1977 | Brock et al. | 428/157 |
| 4,070,218 | 1/1978 | Weber | 156/167 |
| 4,088,731 | 5/1978 | Groome | 264/282 |
| 4,100,324 | 7/1978 | Anderson et al. | 428/288 |
| 4,209,563 | 6/1980 | Sisson | 428/288 |
| 4,340,563 | 7/1982 | Appel et al. | 264/518 |
| 4,419,391 | 12/1983 | Tanaka et al. | 427/387 |
| 4,443,513 | 4/1984 | Meitner et al. | 422/195 |
| 4,606,964 | 8/1986 | Wideman | 428/152 |
| 4,652,487 | 3/1987 | Morman | 428/138 |
| 4,657,802 | 4/1987 | Morman | 428/152 |
| 4,720,415 | 1/1988 | Vander Wielen et al. | 428/152 |
| 4,735,849 | 4/1988 | Murakami et al. | 428/224 |
| 4,806,300 | 2/1989 | Walton et al. | 264/288.8 |
| 4,891,957 | 1/1990 | Strack et al. | 66/192 |
| 4,919,877 | 4/1990 | Parsons et al. | 264/282 |
| 4,923,914 | 5/1990 | Nohr et al. | 524/99 |
| 4,965,122 | 10/1990 | Morman | 428/225 |
| 4,966,725 | 10/1990 | Singer et al. | 252/8.8 |
| 5,041,255 | 8/1991 | Zafiroglu | 264/288.8 |
| 5,078,747 | 1/1992 | Kastele et al. | 8/181 |
| 5,169,706 | 12/1992 | Collier, IV et al. | 428/152 |
| 5,180,843 | 1/1993 | O'Lenick, Jr. | 556/77 |

FOREIGN PATENT DOCUMENTS

| | | |
|---|---|---|
| 0417559A2 | 3/1991 | European Pat. Off. . |
| 62-078277 | 4/1987 | Japan . |
| 2-047371 | 2/1990 | Japan . |
| 4-108104 | 4/1992 | Japan . |
| 93/15247 | 8/1993 | WIPO . |

OTHER PUBLICATIONS

Riggs, C. L.; Sherrill, J. C.; Textile Laundering Technology "Chemistry of Textile Softners" Chapter VII, pp. 71–74 (1979).

Cook, Alton A.; American Dyestuff Reporter "Fabric Softeners-Chemistry of the Soft Touch" pp. 24–26 (Sep. 1973).

Byron L. Richardson; Textile World "Guide to Textile Finishes" pp. 45–46 (Dec. 1973).

*Primary Examiner*—James J. Bell

*Attorney, Agent, or Firm*—James B. Robinson

[57] ABSTRACT

There is provided a method of softening a nonwoven web by wetting a nonwoven web having a starting, unstretched width and a starting cup crush value, with an aqueous solution of softening chemicals, necking the saturated nonwoven web, drying the nonwoven web at a temperature and time sufficient to remove at least 95 percent of the moisture from the nonwoven web, wherein the web has a final cup crush value which is less than 50 percent of the starting cup crush value. The method may optionally include the step of un-necking the nonwoven web to about between 80 and 125 percent of its starting, unstretched width.

13 Claims, 1 Drawing Sheet

CHEMICAL AND MECHANICAL SOFTENING PROCESS FOR NONWOVEN WEB

BACKGROUND OF THE INVENTION

This invention relates to the field of nonwoven fabrics or webs and their manufacture. More particularly, it relates to such nonwoven fabrics which are comprised of at least one layer of staple fibers or filaments or continuous filaments. One example of such nonwoven fabric is a fabric wherein the fibers are microfibers having an average diameter of about 10 microns. Such fibers are commonly comprised of a thermoplastic such as polyolefins such as polypropylene, polyamides, polyesters and polyethers and these microfibrous fabrics or webs have a great ability to absorb liquid materials such as oils. The webs may also be made hydrophilic through various treatments and may be used to absorb aqueous solutions.

Uses for such absorbent microfibrous webs are in such applications as oil and chemical spill cleanup materials, industrial wipers, food service wipes, diapers, feminine hygiene products and barrier products such as medical gowns and surgical drapes.

Various steps have been undertaken to treat the microfibrous webs in order to improve conformability, bulk and especially softness. While some of the techniques currently in use achieve some degree of success, all have certain drawbacks.

The technique of mechanical softening the nonwoven web in a method such as washing is a time consuming, batch process which does not lend itself to the requirements of industrial production. In addition, large volumes of water from the washing process must be handled, either by recycling or disposal and the web must be dried. Drying a nonwoven web is an energy consuming process which is somewhat difficult to control in a commercial setting, sometimes resulting in remelted, glazed or otherwise damaged webs.

The technique of mechanical softening by stretching does not provide the degree of softness being sought for some applications. The technique of chemical softening by treating a web with surface active chemicals also does not provide the degree of softness being sought for some applications.

Accordingly, it is an object of this invention to provide a microfibrous web which is softer than either chemical or mechanical softening alone and which can be performed in a continuous industrial production operation.

SUMMARY

The objects of this invention are achieved by a process which comprises the steps of saturating a nonwoven web having a width with an aqueous solution of softening chemicals, stretching the saturated nonwoven web to a width of between about 50 and 95 percent of its unstretched width and drying the nonwoven web at a temperature and time sufficient to remove at least 95 percent of the moisture from the nonwoven web, wherein the web has a final cup crush value which is less than 50 percent of the starting cup crush value. The softening chemicals are added in an amount of between 0.1 and 10 weight percent of the nonwoven web.

An optional step of stretching the nonwoven web longitudinally or cross-machine directionally to a width of between about 80 and 150 percent of its unstretched width may also be performed.

DETAILED DESCRIPTION OF THE INVENTION

DEFINITIONS

Figure 1:
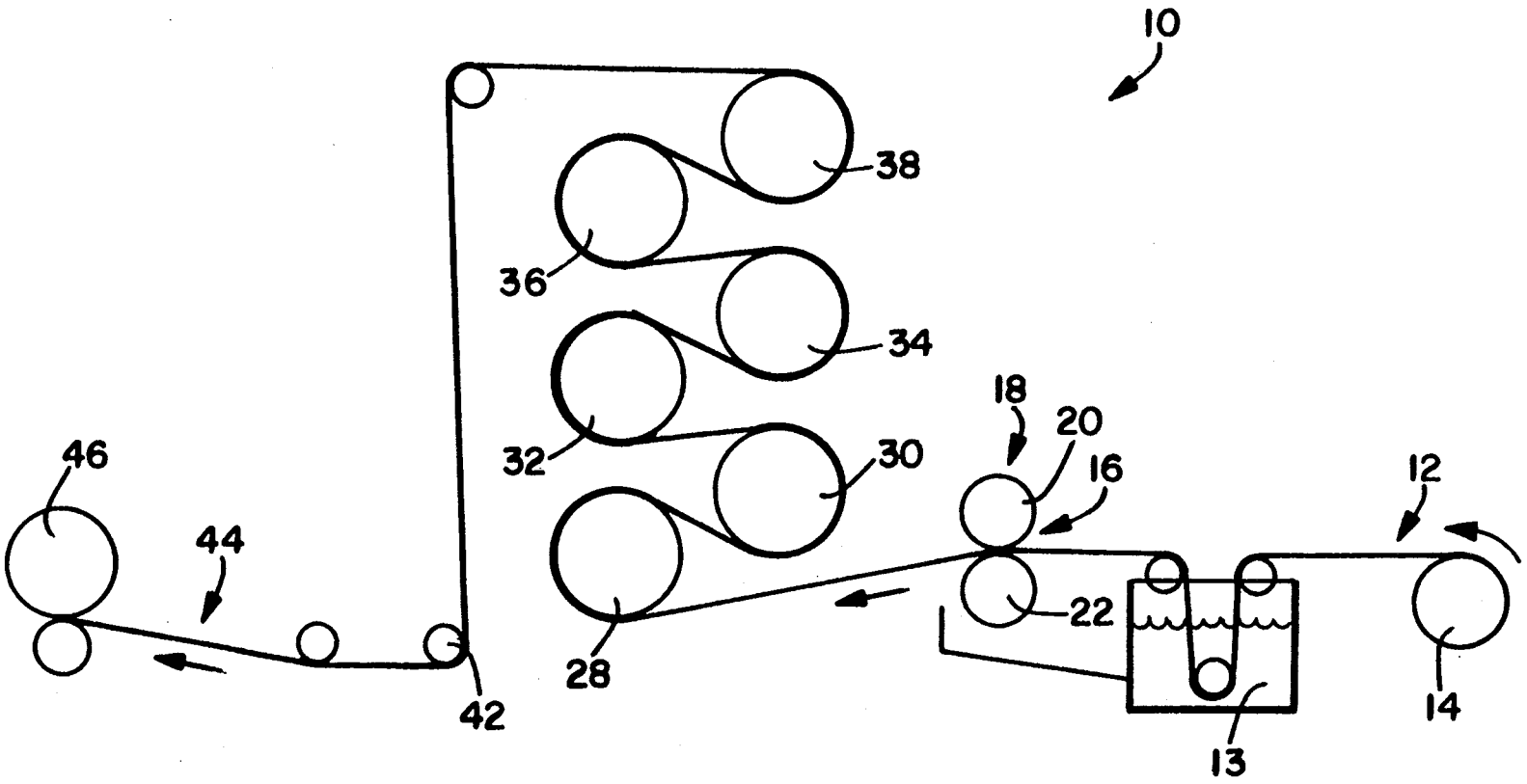
FIG. 1 is a schematic illustration of an apparatus which may be utilized to perform the method and to produce the nonwoven web of the present invention.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns.

As used herein the term "meltblown fibers" means fibers formed by extruding a molten thermoplastic material through a plurality of fine, usually circular, die capillaries as molten threads or filaments into a high. velocity gas (e.g. air) stream which attenuates the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin.

As used herein the term "spunbonded fibers" refers to small diameter fibers which are formed by extruding molten thermoplastic material as filaments from a plurality of fine, usually circular capillaries of a spinnerette with the diameter of the extruded filaments then being rapidly reduced as by, for example, in U.S. Pat. Nos. 4,340,563 to Appel et al., 3,692,618 to Dorschner et al., 3,802,817 to Matsuki et al., 3,338,992 and 3,341,394 to Kinney, 3,502,763 and 3,909,009 to Levy, and 3,542,615 to Dobo et al. Spunbond fibers are generally continuous and larger than 7 microns, more particularly, between about 10 and 20 microns.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

As used herein the term "bicomponent" refers to fibers which have been formed from at least two polymers extruded from separate extruders but spun together to form one fiber. The configuration of such a bicomponent fiber may be, for example, a sheath/core arrangement wherein one polymer is surrounded by another or may be a side by side arrangement or an "islands-in-the-sea" arrangement. The polymers may be present in ratios of 75/25, 50/50, 25/75 or any other desired ratios.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. "Compatibilization" is defined as the process of modifying the interfacial properties of an immiscible polymer blend in order to make an alloy.

As used herein, the term "bonding window" means the range of temperature of calender rolls used to bond the nonwoven fabric together in thermal bonding, over which such bonding is successful. For polypropylene, this bonding window is typically from about 270° F. to about 310° F. (132° C. to 154° C). Below about 270° F. the polypropylene is not hot enough to melt and bond and above about 310° F. the polypropylene will melt excessively and can stick to the calender rolls. Polyethylene has an even narrower bonding window.

As used herein the term "machine direction" refers to the direction of formation of the meltblown or spunbond web. Since such webs are generally extruded onto a moving conveyor belt or "forming wire" the direction of formation of such webs (the machine direction) is the direction of movement of the forming wire. The terms "cross direction" and "cross machine direction" mean a direction which is substantially perpendicular to the machine direction.

As used herein, the terms "necking" or "neck stretching" interchangeably refer to a method of elongating a nonwoven fabric, generally in the machine direction, to reduce its width in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.4 times. When relaxed, the web retracts toward its original dimensions. Such a process is disclosed, for example, in U.S. Pat. No. 4,443,513 to Meitner and Notheis and another in U.S. Pat. No. 4,965,122 to Morman.

As used herein the term "neck softening" means neck stretching carried out without the addition of heat to the material as it is stretched, i.e., at ambient temperature.

As used herein, the term "neckable material" means any material which can be necked.

As used herein, the term "necked material" refers to any material which has been constricted in at least one dimension by processes such as, for example, drawing or gathering.

As used herein the term "un-necking" means a process applied to a reversibly necked material to extend it to at least its original, pre-necked dimensions by the application of a stretching force in a longitudinal or cross-machine direction which causes it to recover to within at least about 50 percent of its reversibly necked dimensions upon release of the stretching force.

As used herein the term "recover" refers to a contraction of a stretched material upon termination of a biasing force following stretching of the material by application of the biasing force. For example, if a material having a relaxed, unbiased length of one (1) inch was elongated 50 percent by stretching to a length of one and one half (1.5) inches the material would have been elongated 50 percent and would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the term "stitchbonded" means, for example, the stitching of a material in accordance with U.S. Pat. No. 4,891,957 to Strack et al.

As used herein, the term "wash softened" refers to the feel of a material that has been softened by washing in a conventional home-type washing machine.

As used herein, the term "garment" means any type of apparel which may be worn. This includes industrial work wear and coveralls, undergarments, pants, shirts, jackets, gloves, socks, and the like.

As used herein, the term "medical product" means surgical gowns and drapes, face masks, head coverings, shoe coverings wound dressings, bandages, sterilization wraps, wipers and the like.

As used herein, the term "personal care product" means diapers, training pants, absorbent underpants, adult incontinence products, and feminine hygeine products.

As used herein, the term "outdoor fabric" means a fabric which is primarily, though not exclusively, used outdoors. The applications for which this fabric may be used include car covers, boat covers, airplane covers, camper/trailer fabric, furniture covers, awnings, canopies, tents, agricultural fabrics and outdoor apparel.

The fabric used in the process of this invention may be a single layer embodiment or a multilayer laminate. Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 6 to about 400 grams per square meter. The process of this invention may also produce fabric which has been laminated with films, glass fibers, staple fibers, paper, and other web materials.

Nonwoven fabrics are generally bonded in some manner as they are produced in order to give them sufficient structural integrity to withstand the rigors of further processing into a finished product. Bonding can be accomplished in a number of ways such as hydroentanglement, needling, ultrasonic bonding, adhesive bonding and thermal bonding. Thermal bonding is the method preferred in this invention.

Thermal bonding of a nonwoven fabric may be accomplished by passing the nonwoven fabric between the rolls of a calendering machine. At least one of the rollers of the calender is heated and at least one of the rollers, not necessarily the same one as the heated one, has a pattern which is imprinted upon the nonwoven fabric as it passes between the rollers. As the fabric passes between the rollers it is subjected to pressure as well as heat. The combination of heat and pressure applied in a particular pattern results in the creation of fused bond areas in the nonwoven fabric where the bonds on the fabric correspond to the pattern of bond points on the calender roll.

Various patterns for calender rolls have been developed. One example is the Hansen-Pennings pattern with between about 10 and 25% bond area with about 100 to 500 bonds/square inch as taught in U.S. Pat. No. 3,855,046 to Hansen and Pennings. Another common pattern is a diamond pattern with repeating and slightly offset diamonds.

The exact calender temperature and pressure for bonding the nonwoven web depend on thermoplastic(s) from which the web is made. Generally for polyolefins the preferred temperatures are between 150° and 350° F. (66° and 177° C.) and the pressure between 200 and 1000 pounds per lineal inch. More particularly, for polypropylene, the preferred temperatures are between 260° and 320° F. (125° and 160° C.) and the pressure between 400 and 800 pounds per lineal inch.

The thermoplastic polymers which may be used in the practice of this invention may be any known to those skilled in the art to be commonly used in meltblowing and spunbonding. Such polymers include polyolefins, polyesters, polyetherester, polyurethanes and polyamides, and mixtures thereof, more particularly polyolefins such as polyethylene, polypropylene, polybutene, ethylene copolymers, propylene copolymers and butene copolymers.

Referring to the drawings where like reference numerals represent like figures or process steps and, in part, to FIG. 1 there is schematically illustrated at 10 an exemplary process for forming a chemically and mechanically softened material.

A neckable material 12 is unwound from a supply roll. 14. The neckable material 12 is saturated with an aqueous solution of chemical softening agents 13 by going through a dip and then passes through a nip 16 of a drive roller arrangement 18 formed by the drive rollers 20 and 22. This procedure is known as the "dip and squeeze" process. Any other process which sufficiently saturates the web will also function, an example of which is spraying the chemical softening agents onto the web.

The neckable material 12 may be formed by known nonwoven processes, such as, for example, meltblowing processes, spunbonding processes or bonded carded web processes and passed directly through the nip 16 without first being stored on a supply roll.

The neckable material 12 may be a nonwoven material such as, for example, spunbonded web, meltblown web or bonded carded web. If the neckable material 12 is a web of meltblown fibers, it may include meltblown microfibers. The neckable material 12 is made from any material that can be treated while necked so that, after treatment, upon application of an un-necking force to extend the necked material to its pre-necked dimensions, the material recovers generally to its necked dimensions upon termination of the force. A method of treatment is the application of heat. Certain polymers such as, for example, polyolefins, polyesters and polyamides may be heat treated under suitable conditions to impart such memory. Exemplary polyolefins include one or more of polyethylene, polypropylene, polybutene, ethylene copolymers, propylene copolymers and butene copolymers. Polypropylenes that have been found useful include, for example, polypropylene available from the Himont Corporation of Wilmington, Del., under the trade designation PF-304, polypropylene available from the Exxon Chemical Company of Baytown, Tex. under the trade designation Exxon 3795G, and polypropylene available from the Shell Chemical Company of Houston, Tex. under the trade designation DX 5A09.

In one embodiment of the present invention, the neckable material 12 is a multilayer material having, for example, at least one layer of spunbonded web joined to at least one layer of meltblown web, bonded carded web or other suitable material. For example, the neckable material 12 may be multilayer material having a first layer of spunbonded polypropylene having a basis weight from about 0.2 to about 8 ounces per square yard (osy), a layer of meltblown polypropylene having a basis weight from about 0.2 to about 4 osy, and a second layer of spunbonded polypropylene having a basis weight of about 0.2 to about 8 osy.

Alternatively, the neckable material 12 may be single layer of material such as, for example, a spunbonded web having a basis weight of from about 0.2 to about 10 osy or a meltblown web having a basis weight of from about 0.2 to about 8 osy.

The neckable material 12 may also be a composite or coformed material made of a mixture of two or more different fibers or a mixture of fibers and particulates. Such mixtures may be formed by adding fibers and/or particulates to a gas stream in which meltblown fibers are carried so that an intimate entangled commingling of meltblown fibers and other materials, e.g., wood pulp, staple fibers or particulates such as, for example, superabsorbent materials occurs prior to collection of the fibers upon a collecting device to form a coherent web of randomly dispersed meltblown fibers and other materials such as disclosed in U.S. Pat. No. 4,100,324.

If the neckable material 12 is a nonwoven web of fibers, the fibers should be joined by interfiber bonding to form a coherent web structure which is able to withstand necking. Interfiber bonding may be produced by entanglement between individual meltblown fibers. The fiber entangling is inherent in the meltblown process but may be generated or increased by processes such as, for example, hydraulic entangling or needlepunching. Alternatively and/or additionally a bonding agent may be used to increase the desired bonding or bonding may be accomplished by ultrasonic, print or thermal point bonding.

After passing through the nip 16 of the driver roller arrangement 18, the neckable material 12 passes over a series of steam cans 28–38 in a series of reverse S loops. The steam cans 28–38 typically have an outside diameter of about 24 inches although other sized cans may be used. The contact time or residence time of the neckable material on the steam cans to effect heat treatment will vary depending on factors such as, for example, steam can temperature, and type and/or basis weight of material. For example, a necked web of polypropylene may be passed over a series of steam cans heated to a measured temperature from room temperature to about 150° C. (194°–302° F.) for a contact time of about 1 to about 300 seconds to effect heat treatment. More particularly, the temperature may range from about 100° to about 135° C. and the residence time may range from about 2 to about 50 seconds.

Because the peripheral linear speed of the drive rollers 20 and 22 is controlled to be lower than the peripheral linear speed of the steam cans 28–38, the neckable material 12 is tensioned between the steam cans 28–38 and the drive rollers 20 and 22. By adjusting the difference in the speeds of the rollers, the neckable material 12 is tensioned so that it necks a desired amount and is maintained in such necked condition while passing over the heated steam cans 28–38. This action imparts memory of the necked condition to the neckable material 12. The peripheral linear speed of the rollers of the idler roller arrangement 42 may be maintained at a higher speed then the steam cans 28–38 so that the necked material 12 is further stretched and also cooled in the necked condition on its way to the wind-up roll 46. This completes formation of the reversibly necked material 44. The reversibly necked material 44 can be extended to about its original, pre-necked dimensions upon application of a stretching force in a generally cross-machine direction. Un-necking of a fabric is accomplished through the use of commercially available devices such as tentering frames which grab the edges of the fabric and pull it to the desired width. The material can then recover to within at least about 50 percent of its reversibly necked dimensions upon release of the stretching force. According to the present invention, elongation or percent stretch values of greater than 170 percent have been achieved.

Conventional drive means and other conventional devices which may be utilized in conjunction with the apparatus of FIG. 1 are well known and, for purposes of clarity, have not been illustrated in the schematic view of FIG. 1.

The softening chemicals are added in an amount of between 0.1 and 10 weight percent of the nonwoven web. These chemicals may be any of those commonly known to those skilled in the art as being useful for softening textiles. Softeners may be silicone, anionic, nonionic or cationic though cationic softeners are preferred.

Anionic softeners are generally chemical compounds such as sulfated oils like castor, olive and soybean, sulfated synthetic fatty esters, such as glyceryl trioleate, and sulfated fatty alcohols of high molecular weight.

Nonionic softeners are highly compatible with other finishing agents and are generally compounds such as glycols, glycerin, sorbitol and urea. Compounds of fatty acids like polyglycol esters of high molecular weight saturated fatty acids such as palmitic and stearic acids are other examples.

Cationic softeners are generally long chain amides, imidazolines, and quarternary nitrogen compounds. One suitable cationic softener is a tallow based quarternary ammonium compound sold under the tradename Varisoft®.

Textile softeners are discussed in *Textile Laundering Technology* (1979), Riggs, C. L., and Sherill, J. C. (p. 71–74), the magazine American Dyestuff Reporter, September 1973 (p. 24–26) and the magazine Textile World, December 1973 (p. 45–46).

The softness of a nonwoven fabric may be measured according to the "cup crush" test. The cup crush test evaluates fabric stiffness by measuring the peak load required for a 4.5 cm diameter hemispherically shaped foot to crush a 23 cm by 23 cm piece of fabric shaped into an approximately 21 cm diameter by 6.5 cm tall inverted cup while the cup shaped fabric is surrounded by an approximately 21 cm diameter cylinder to maintain a uniform deformation of the cup shaped fabric. The foot and the cup are aligned to avoid contact between the cup walls and the foot which could affect the peak load. The peak load is measured while the foot is descending at a rate of about 0.25 inches per second (38 cm per minute). A lower cup crush load value indicates a softer laminate. A suitable device for measuring cup crush is a model FTD-G-500 load cell (500 gram range) available from the Schaevitz Company, Pennsauken, N.J. Cup crush load is usually measured in grams. Cup crush energy is measured in gm-mm.

An absolute cup crush load value of about 70 grams or less is considered desirably soft for the purposes of this invention. Fabrics processed according to this invention have a final cup crush load value of at least 50 percent less than the starting cup crush value of such a fabric, i.e., the final cup crush load value is no more than 50% of the starting cup crush load value.

The following examples show the effect of various treatment methods on the cup crush values of nonwoven material. Note that because of the standard deviation of the cup crush test, each data point represents the measurement of at least five individual fabrics.

EXAMPLE 1

A nonwoven spunbond-meltblown-spunbond (SMS) laminate was made generally according to U.S. Pat. No. 4,041,203 in which the layers were sequentially deposited onto a moving forming wire. The layers were respectively 0.5-0.5-0.5 osy (17-17-17 gsm) for a 1.5 osy (51 gsm) total basis weight for the laminate. The polymers used to produce the layers were respectively, PF-304 available from the Himont Corporation, 3795G available from the Exxon Chemical Company, and PF-304. The laminate was thermally point bonded to produce a coherent nonwoven web.

In this example the laminates were washed in a conventional home-type washing machine. The wash cycle was 30 minutes long and used warm water and ½ cup of Tide® detergent. In the samples which were washed more than once, more detergent was added after each wash and the next wash cycle begun without drying between cycles. After all of the wash cycles were completed, each sample was put into a conventional home-type dryer on the low setting for 30 minutes. The SMS laminates were then tested for cup crush values and the results are reported in Table 1.

TABLE 1

| Sample | Control | Value | % change |
|---|---|---|---|
| 1.5 osy SMS | 205 | same | NA |
| 1.5 osy SMS washed 1 time | 205 | 70 | −66 |
| 1.5 osy SMS washed 5 times | 205 | 50 | −76 |

The results clearly show the dramatic increase in softness attributable to mechanical softening through washing alone. Not only does washing result in a great decrease in the cup crush value in percentage terms, but the absolute value of the cup crush indicates a very soft fabric.

Washing is, unfortunately, a very water, labor, and energy intensive method for softening a nonwoven fabric. Washing is a batch process which is not well suited to the continuous production of large volumes of fabric.

EXAMPLE 2

A nonwoven spunbond-meltblown-spunbond (SMS) laminate: was made generally according to U.S. Pat. No. 4,041,203 in which the layers were sequentially deposited onto a moving forming wire. The layers were respectively 0.55-0.5-0.55 osy (19-17-19 gsm) for a 1.6 osy (54 gsm) total basis weight for the laminate. The polymers used to produce the layers were the same as in Example 1 above. The laminate was thermally point bonded to produce a coherent nonwoven web.

In this example, the laminates were neck softened to a width of 80% of the starting, unstretched width (i.e., by 20%). The SMS laminates were then tested for cup crush values and the results are reported in Table 2.

TABLE 2

| Sample | Control | Value | % change |
|---|---|---|---|
| 1.6 osy SMS, not neck softened | 295 | same | NA |
| 1.6 osy SMS, 20% neck softened | 295 | 243 | −18 |

The results show that neck softening can reduce the cup crush of a nonwoven fabric by a significant amount.

EXAMPLE 3

A nonwoven spunbond-meltblown-spunbond (SMS) laminate the same as that of Example 2 was used for this example.

In this example, the laminates were neck stretched by the percent of the starting, unstretched width as shown in Table 3 and at between 230° and 250° F. (110° and 121° C.). The SMS laminates were then tested for cup crush values and the results are shown in Table 3.

TABLE 3

| % necking | Control | Value | % change |
|---|---|---|---|
| 0 | 180 | same | NA |
| 20 | 180 | 140 | −22 |
| 30 | 180 | 120 | −33 |
| 40 | 180 | 116 | −36 |
| 45 | 180 | 105 | −42 |
| 50 | 180 | 94 | −48 |

The results show that neck stretching can decrease the cup crush in amounts roughly proportional to the amount of neck stretching. The absolute cup crush values, however, were far above the results of mechanical washing alone.

EXAMPLE 4

A nonwoven spunbond-meltblown-spunbond (SMS) laminate the same as Example 1 was used for this example.

In this example, the laminates were treated with two softening chemicals. The chemicals were Y-12230 which is a polyalkyleneoxide modified polydimethyl siloxane and is commercially available from the OSI (formerly a division of Union Carbide Corp.) of Danbery, Conn. and Triton X-405, an alkylaryl polyether alcohol, available from the Rohm & Haas Company of Philadelphia, Pa. The chemicals were mixed with water to produce an aqueous solution containing the weight percent of the chemical as shown in Table 4. The treatment was applied to the webs by the "dip and squeeze" method described above, though alternatives like spraying would also function. The SMS laminates were then tested for cup crush values and the results are reported in Table 4.

TABLE 4

| Sample | Control | Value | % change |
|---|---|---|---|
| 1.5 osy SMS, not treated | 205 | same | NA |
| 1.5 osy SMS, 0.5% Y-12230 | 205 | 179 | −13 |

TABLE 4-continued

| Sample | Control | Value | % change |
|---|---|---|---|
| 1.5 osy SMS, 0.3% Triton X-405 | 205 | 161 | −21 |

The results show that certain chemical treatments alone can reduce the cup crush of a nonwoven fabric by about 15 to 20%.

EXAMPLE 5

A nonwoven spunbond-meltblown-spunbond (SMS) laminate the same as Example 2 was used for this example.

In this example, the laminates were neck stretched by 30% at a temperature of 230° F. (110° C.) and then treated with three different softening chemicals. In the Table (5), the first two lines show the results for the base fabric without neck stretching (N.S.) or treatment and for only neckstretching, respectively. The chemicals used were Y-12230, Triton X-405, and Ultralube, a proprietary surfactant hydrocarbon blend, which is available from MFG Chemical and Supply, Inc. of Dalton Ga. The chemicals were mixed with water to produce an aqueous solution containing the weight percent of the chemical as shown in Table 5. The treatment was applied to the webs by the "dip and squeeze" method described above, though alternatives like spraying would also function. The SMS laminates were then tested for cup crush values and the results are reported in Table 5.

TABLE 5

| Sample | Control | Value | % change |
|---|---|---|---|
| Not N.S., not treated | 226 | same | NA |
| 30% N.S., not treated | 226 | 114 | −50 |
| 30% N.S. then 1.0% Y-12230 | 226 | 119 | −47 |
| 30% N.S. then 1.0% Triton X-405 | 226 | 143 | −37 |
| 30% N.S. then 1.0% Ultralube | 226 | 156 | −31 |

The results show that neck stretching followed by certain chemical treatments can reduce the cup crush of a nonwoven fabric up to about 50%. The absolute cup crush values, however, were far above the results of mechanical washing alone.

EXAMPLE 6

A nonwoven spunbond-meltblown-spunbond (SMS) laminate the same as Example 1 was used for this example.

In this example, the laminates were treated with three different softening chemicals and then neck stretched by 30%, except for the final sample which was neck stretched by 40%, at a temperature of about 245° F. (118° C). In the Table (6), the first line shows the results for the base fabric without neck stretching or treatment.

The softening chemicals used were Y-12230, Triton X-405, and Varisoft® 137 which is available from Sherex Chemical Co. of Dublin, Ohio. Varisoft is a dihydrogenated tallow dimethyl ammonium methyl sulfate and has CAS number G8002-58-4. Hexanol is used as a co-surfactant for the Y-12230 and is driven off during the drying of the nonwoven so that it does not remain in any effective amount in the finished product. The chemicals were mixed with water to produce an aqueous solution containing the weight percent of the chemical as shown in Table 6. The treatment was applied to the webs by the "dip and squeeze" method described above, though alternatives like spraying would also function. The SMS laminates were then tested for cup, crush values and the results are reported in Table 5.

TABLE 6

| Sample | Control | Value | % change |
|---|---|---|---|
| Not treated, not N.S. | 226 | same | NA |
| 30% N.S. with 0.5% Y-12230 | 226 | 112 | −50 |
| 30% N.S. with 0.3% Triton X-405 | 226 | 110 | −52 |
| 30% N.S. with 1.0% Varisoft | 226 | 102 | −55 |
| 40% N.S. with 1.0% Varisoft, 0.5% Y-12230, and 0.5% hexanol (1.6 osy SMS) | 226 | 72 | −68 |

The results show that treatment with certain chemicals followed by neck stretching can reduce the cup crush of a nonwoven fabric up to about 70%, yielding an absolute cup crush value in the range of washed fabrics.

EXAMPLE 7

A nonwoven spunbond-meltblown-spunbond (SMS) laminate the same as Example 2 was used for this example.

In this example, the laminates were neck stretched in the amounts shown, at a temperature of about 230° to 250° F. (110° to 121° C.) and then un-necked to a width about 20% greater than their original width according to the procedure described above. In the Table (7), the first line shows the results for the base fabric without neck stretching, treatment or un-necking.

The treatment for those webs having treatment was applied to the webs by the "dip and squeeze" method described above, though alternatives like spraying would also function. The SMS laminates were then tested for cup crush values and the results are reported in Table 7.

TABLE 7

| Sample | Control | Value | % change |
|---|---|---|---|
| Not treated, not N.S. | 180 | same | NA |
| 30% N.S. | 180 | 95 | −47 |
| 40% N.S. | 180 | 86 | −52 |
| 40% N.S. with 1.0% Varisoft, 0.5% Y-12230, and 0.5% hexanol | 180 | 51 | −72 |

The results show that treatment with certain chemicals followed by neck stretching and un-necking can reduce the cup crush of a nonwoven fabric about 70%, yielding an absolute cup crush value in the range of washed fabrics.

The above examples show that a nonwoven fabric comparable in softness to a washed fabric can be produced through chemical and mechanical treatment in a continuous, commercially feasible operation. The resulting fabric, though soft, retains a sufficient amount of its original properties e.g.: strength, to be of use in a number of useful products.

This method comprises the steps of saturating a nonwoven web with an aqueous solution of softening chemicals, stretching the saturated nonwoven web to a width of between about 50 and 95 percent of its unstretched width, and drying the nonwoven web at a temperature and time sufficient to remove at least 95 percent of the moisture from the nonwoven web. A web treated in such a way has a final cup crush value which is less than 50 percent of the starting cup crush value.

An optional step of stretching the nonwoven web to a width of between about 80 and 150 percent of its unstretched width may also be performed.

I claim:

1. A method of softening a nonwoven web comprising the steps of;

wetting a nonwoven web having a starting, unstretched width and a starting cup crush value, with an aqueous solution of softening chemicals, necking the saturated nonwoven web to a second width of between about 50 and 95 percent of its starting, unstretched width, drying the nonwoven web at a temperature and time sufficient to remove at least 95 percent of the moisture from the nonwoven web, wherein said web has a final cup crush value which is less than 50 percent of said starting cup crush value.

2. The method of claim 1 further comprising the step of un-necking said nonwoven web to a third width of between about 80 and 150 percent of its starting, unstretched width.

3. The method of claim 1 wherein said softening chemicals are cationic.

4. The method of claim 1 wherein said web is comprised of microfibers of a polymer selected from the group consisting of polyolefins, polyamides, polyetheresters and polyurethanes.

5. The method of claim 4 wherein said polymer is a polyolefin.

6. The method of claim 5 wherein said polyolefin is polypropylene.

7. The method of claim 5 wherein said polyolefin is polyethylene.

8. The method of claim 1 wherein said web is produced by a process selected from the group consisting of spunbond, meltblown and bonded carded web processes.

9. The method of claim 1 wherein said web is a laminate comprising at least one meltblown layer and at least one spunbond layer.

10. The method of claim 9 wherein said web is a laminate comprising a first spunbond layer, a meltblown layer and a second spunbond layer, and which has been bonded together.

11. The method of claim 10 wherein said web has been thermally point bonded.

12. A method of softening a nonwoven web comprising the steps of:

wetting a nonwoven web having a starting, unstretched width and a starting cup crush value, with an aqueous solution having between 0.1 and 10 weight percent of chemical softeners, necking the saturated nonwoven web to a second width of between about 60 and 90 percent of its unstretched width, drying the nonwoven web at a temperature and time sufficient to remove at least 95 percent of the moisture from the nonwoven web, un-necking said nonwoven web to a width of between about 90 and 120 percent of its starting, unstretched width, and;

wherein said web has a final cup crush value which is less than 50 percent of said starting cup crush value.

13. The method of claim 12 wherein said nonwoven web is a thermally point bonded laminate of a first polyolefin spunbond layer, a polyolefin meltblown layer and a second polyolefin spunbond layer.

* * * * *

UNITED STATES PATENT AND TRADEMARK OFFICE

CERTIFICATE OF CORRECTION

PATENT NO. : 5,413,811
DATED : May 9, 1995
INVENTOR(S) : Steven W. Fitting, et al It is certified that error appears in the above-indentified patent and that said Letters Patent is hereby corrected as shown below:

Column 5, line 38, "roll.14." should read --roll 14.--;

Column 11, line 2, "in Table 5" should read --in Table 6--.

Signed and Sealed this

Twenty-fourth Day of October, 1995

*Attest:*

*Attesting Officer*

BRUCE LEHMAN

*Commissioner of Patents and Trademarks*